US011343606B2

(12) United States Patent
Roberts

(10) Patent No.: US 11,343,606 B2
(45) Date of Patent: May 24, 2022

(54) HEADPHONE OR EARPHONE

(71) Applicant: Flare Audio Technologies Limited, West Sussex (GB)

(72) Inventor: Davies Roberts, Sussex (GB)

(73) Assignee: FLARE AUDIO TECHNOLOGIES LIMITED, West Sussex (GB)

( * ) Notice: Subject to any disclaimer, the term of this patent is extended or adjusted under 35 U.S.C. 154(b) by 863 days.

(21) Appl. No.: 15/562,368

(22) PCT Filed: Apr. 7, 2016

(86) PCT No.: PCT/GB2016/050981
§ 371 (c)(1),
(2) Date: Sep. 27, 2017

(87) PCT Pub. No.: WO2016/162681
PCT Pub. Date: Oct. 13, 2016

(65) Prior Publication Data

US 2018/0288520 A1 Oct. 4, 2018

(30) Foreign Application Priority Data

Apr. 10, 2015 (GB) ..... 1506111
Oct. 20, 2015 (GB) ..... 1518586

(51) Int. Cl.
*H04R 1/10* (2006.01)
*H04R 1/02* (2006.01)

(52) U.S. Cl.
CPC ..... *H04R 1/1075* (2013.01); *H04R 1/025* (2013.01); *H04R 1/1016* (2013.01); *H04R 1/1033* (2013.01)

(58) Field of Classification Search
CPC ..... H04R 2460/11
See application file for complete search history.

(56) References Cited

U.S. PATENT DOCUMENTS 5,682,434 A * 10/1997 Boyden ..... H04M 1/05 381/385
2008/0166001 A1 7/2008 Hankey et al.
(Continued)

FOREIGN PATENT DOCUMENTS

CN 202035122 U * 11/2011
CN 203661262 6/2014
(Continued)

OTHER PUBLICATIONS

International Search Report and Written Opinion for PCT/GB2016/050981 dated Jul. 7, 2016.
(Continued)

*Primary Examiner* — Angelica M McKinney
(74) *Attorney, Agent, or Firm* — Basil M. Angelo; Angelo IP

(57) ABSTRACT

A headphone or earphone (10; 50) consists of a casing (12) adapted to fit to a user's ear, the casing (12) enclosing a driver (22) with a diaphragm. Behind the driver (22) is a rear closure element (15; 52); and the driver (22) is clamped against at least one resilient element (23) that engages with its front face near the periphery, or alternatively is clamped between two such resilient elements (23, 24). The casing (12) defines a cavity in front of the driver (22) that communicates with a sound outlet duct (18) adapted to provide sound to the user's ear. The sound outlet duct (18) may define a restrictive duct portion with a cross-sectional area between 18% and 28% of the cross-sectional area of the diaphragm. Behind the driver (22) may be an enclosed airtight cavity, or alternatively the rear closure element (52) may define a rear outlet duct (54) aligned with the sound outlet duct (18).

21 Claims, 5 Drawing Sheets

(56) References Cited

U.S. PATENT DOCUMENTS

| | | | | |
|---|---|---|---|---|
| 2010/0322453 | A1 | 12/2010 | Matsuyama et al. | |
| 2011/0051978 | A1 | 3/2011 | Chen | |
| 2011/0051981 | A1 | 3/2011 | Lehdorfer et al. | |
| 2011/0081034 | A1* | 4/2011 | Tung | H04R 1/1016 381/332 |
| 2012/0087533 | A1 | 4/2012 | Nageno et al. | |
| 2012/0314882 | A1 | 12/2012 | Sibbald | |
| 2014/0056455 | A1 | 2/2014 | Sakaguchi et al. | |
| 2014/0348372 | A1* | 11/2014 | Seo | H04R 1/1016 381/380 |
| 2015/0023541 | A1 | 1/2015 | Ho | |
| 2015/0172800 | A1 | 6/2015 | Azmi et al. | |
| 2017/0201822 | A1* | 7/2017 | Shetye | H04R 1/347 |
| 2018/0146279 | A1* | 5/2018 | Wang | H04R 1/1058 |

FOREIGN PATENT DOCUMENTS

| | | | | | |
|---|---|---|---|---|---|
| CN | 104936080 | A | * | 9/2015 | |
| CN | 110944266 | B | * | 7/2021 | H04R 1/1016 |
| EP | 1058479 | | | 12/2000 | |
| EP | 2187654 | | | 5/2010 | |
| KR | 101558091 | | | 10/2015 | |
| WO | 2008118248 | | | 10/2008 | |
| WO | 2013114864 | | | 5/2015 | |

OTHER PUBLICATIONS

Search Report for GB1518586.1 dated Dec. 22, 2015.
Search Report for GB1506111.2 dated Jul. 13, 2015.

* cited by examiner

HEADPHONE OR EARPHONE

This invention relates to a headphone or earphone, particularly but not exclusively an earphone that is placed by a user in the end of his ear.

Headphones and earphones are often used by a person who wishes to listen to music or to a radio in such a way that other nearby people don't also hear it. Earphones may be referred to as "in-ear monitors" or IEMs, or "in-ear headphones", and may be sized to fit within the user's ear canal, so they may be almost invisible in use. Headphones in contrast typically fit over the outside of the ear, being supported by a band passing over the top of the head, and are therefore considerably larger. By way of example an earphone may incorporate a diaphragm of diameter less than 10 mm, for example 8 mm or 5 mm, whereas a headphone may incorporate a diaphragm typically less than 60 mm, for example 35 mm or 20 mm. In each case the sound source is much smaller than a conventional loudspeaker, so that there may be problems in achieving accurate sound reproduction over the entire audible sound spectrum.

According to the present invention there is provided a headphone or earphone consisting of a casing adapted to fit to a user's ear, the casing defining a cavity to locate a driver and also defining a sound outlet duct that communicates with a front end of the cavity to provide sound to the user's ear, and the casing being provided with a rear closure element, the casing enclosing a driver with a diaphragm at a front face of the driver, so that the driver divides the driver-locating cavity into a rear cavity behind the driver and a front cavity in front of the driver, wherein the front cavity communicates with the sound outlet duct; and also comprising at least one resilient element, such that the driver is clamped between a resilient element that engages with its front face near the periphery and a rear element that engages the rear face, the resilient element that engages the front face being compressed between an end face of the front cavity and the front face of the driver.

The resilient element may be an O-ring seal or gasket, and may seal the periphery of the front face of the driver to the end face of the front cavity.

In one option the rear element is also a resilient element, and engages the rear face of the driver near its periphery; the rear element in this case may be compressed between the rear face of the driver and the end face of the rear cavity.

The rear closure element may be connected to the casing by a threaded connection, or may be secured by a latch or clip mechanism. In particular the rear closure element may at least partly fit within an end portion of the cavity, and the threaded connection may comprise a screw thread on the inside wall of that end portion of the cavity.

The sound outlet duct preferably includes a tapered duct portion, which may be where the front end of the cavity communicates with the sound outlet duct, and the taper may for example be inclined at between 40° and 50°, for example at 45°, to a longitudinal axis of the sound outlet duct.

The sound outlet duct is of less width than the diaphragm, and may define a restrictive duct portion with a cross-sectional area between 19% and 30% of the cross-sectional area of the diaphragm. The restrictive duct portion is the portion of the sound outlet duct of the least cross-sectional area. If both the diaphragm and the restrictive duct portion are of circular cross-section, then this limitation is equivalent to requiring that the diameter of the restrictive duct portion is between about 44% and 55% of the diameter of the diaphragm, the optimum being about 49% of the diameter of the diaphragm.

The rear cavity may be an enclosed airtight cavity; or alternatively the rear cavity may define a rear outlet port. The rear outlet port, where it is provided, may be axially aligned with the sound outlet duct, and desirably defines a rear restrictive duct portion of the same cross-sectional area as the restrictive duct portion of the sound outlet duct. These features are discussed in more detail below in relation to other aspects of the invention.

It will be appreciated that an electrical connection must be made to the driver. This requires a cable connected to the rear of the driver. This may utilise a cable guide.

In another aspect the invention provides a cable guide for use in a casing of an earphone, headphone or microphone, the casing defining a cylindrical cavity with a wall that defines a slot for entry of a cable, and the casing being provided with a rear closure element, wherein the cable guide defines an inlet duct that can locate in the slot, and a clamping ring that fits coaxially within the cylindrical cavity, wherein the cable guide comprises two mating parts: a first part that defines one side of the inlet duct and defines an arcuate portion of one face of the clamping ring so as to define a circumferential gap between the ends of the arcuate portion; and a second part that defines the other side of the inlet duct, and also defines the remainder of the clamping ring, such that when the two parts are put together the clamping ring has a substantially continuous front face and a substantially continuous rear face.

During assembly there is no requirement to feed the cable through the cable guide, which may indeed be difficult if the end of the cable has been soldered to a an electro-acoustic transducer such as a driver within the casing. It is merely necessary to lay the cable into the first part of the cable guide, passing the cable through the circumferential gap between the ends of the arcuate portion, and then mate the first part and the second part of the cable guide together. In combination the first part and the second part form a clamping ring that has a substantially continuous front face and a substantially continuous rear face.

In one embodiment the second part defines a ring that forms a rear face of the clamping ring, from which projects an arcuate portion that fits in the circumferential gap between the ends of the arcuate portion of the first part. In an alternative embodiment the first portion defines not only the arcuate portion, but also a rearwardly-projecting arcuate part; and the second portion defines an arcuate ring-portion with a gap into which the rearwardly-projecting arcuate part fits.

Hence if there is a driver in the casing, the cable to the driver may be fed through the cable guide, and the rear closure element may then provide pressure to the rear face of the clamping ring. The clamping ring enables substantially uniform pressure to be provided around the entire periphery of the driver, while the cable guide ensures that the cable itself is not compressed.

The inlet duct preferably defines a clamp to clamp the cable, for example an internal ridge, so that tension on the cable is transferred to the cable guide and so to the casing, rather than acting directly on a soldered joint where the cable is fixed to the driver.

Such a cable guide may in some cases be made of metal. More typically it is made of a plastics material such as polyurethane, polyvinyl chloride, nylon (polyamide) and Delrin™ (polyoxymethylene or acetal). The choice of plastic may depend on use and flexibility required in a particular context. With a larger casing containing a larger driver it may be desirable to use a more flexible plastic so that there is some flexibility in the inlet duct; while with a smaller casing it may be preferable to use a harder plastic. The cable guide, if made from a plastic material, typically provides some resilience, helping to seal the periphery of the driver to the casing. Consequently in this case it is not generally necessary to use a gasket or O-ring behind the driver.

According to another aspect of the present invention there is provided a headphone or earphone consisting of a casing adapted to fit to a user's ear, the casing enclosing a driver with a diaphragm, and defining an enclosed airtight cavity behind the driver, and a cavity in front of the driver that communicates with a sound outlet duct adapted to provide sound to the user's ear, the sound outlet duct defining a restrictive duct portion with a cross-sectional area between 19% and 30% of the cross-sectional area of the diaphragm.

As mentioned above, the restrictive duct portion is the portion of the sound outlet duct of the least cross-sectional area. If both the diaphragm and the restrictive duct portion are of circular cross-section, then this limitation is equivalent to requiring that the diameter of the restrictive duct portion is between about 44% and 55% of the diameter of the diaphragm, the optimum being about 49% of the diameter of the diaphragm.

Preferably the driver is sealed to the casing. The driver may for example be sealed to the casing by being clamped with a seal that engages with its front face near the periphery, the seal being compressed between end face of the cavity in front of the driver and the face of the driver. Indeed the driver may be clamped between two such seals, which respectively engage the front face and the rear face. These may be O-ring seals or gaskets, which correspond in shape to the external shape of the driver, for example being circular ring-shaped where the casing and the driver are cylindrical. These ensure that the driver as a whole does not vibrate or rattle in the casing.

The cavity in front of the driver, i.e. the front cavity, may be less than 3 mm deep, and the casing is preferably arranged to minimise the depth of the front cavity; but clearly the end wall of the front cavity must not be so close as to obstruct the transmission of sound from the driver.

The airtight cavity behind the driver (i.e. the rear cavity) may also be less than 3 mm deep and preferably no more than 2 mm deep. As with the front cavity, the driver may be spaced apart from the opposite end of the rear cavity by a compressed seal, so that the thickness of the compressed seal defines the depth of the rear cavity. The rear cavity may be of the same depth as the front cavity, or may be less deep than the front cavity. It will be appreciated that the driver typically has at least one vent hole behind the diaphragm, which communicates with the rear cavity; the airtight cavity behind the driver, i.e. the rear cavity, is therefore in communication with the free space within the driver but behind the diaphragm. In an extreme case the rear cavity may therefore be of zero depth, merely sealing the rear of the driver so that the free space within the driver behind the diaphragm is rendered airtight. However, since it is usually necessary to make electrical contact at the rear of the driver, it is typically advantageous to provide a rear cavity which is sufficiently deep to accommodate the requisite electrical connections, but no deeper than that. The electrical connection may use a cable guide as described above.

It appears that the provision of the restrictive duct portion in the sound outlet duct, in combination with the airtight cavity behind the driver, causes pressure increases both in front of the diaphragm and behind the diaphragm, and it is surmised that these counteract each other. This surprisingly has been found to increase the operating range of the driver so it can provide a linear response over the entire audible frequency range, for example between 20 Hz and 20 kHz. It is surmised that in use, when the headphone or earphone is held against or in an ear so that the sound outlet duct communicates into an enclosed space defined by or within the ear itself, there is effectively a balance between the pressures behind the diaphragm and in front of the diaphragm. If the cross-sectional area of the restrictive duct portion is larger than 30% of the diaphragm's cross-sectional area, then the reproduction of both bass and treble frequencies becomes less effective; while if the cross-sectional area of the restrictive duct portion is smaller than 19% of the diaphragm's cross-sectional area then there is distortion of the bass and treble sounds, presumably due to excess sound pressure.

According to another aspect of the present invention there is provided a headphone or earphone consisting of a casing adapted to fit to a user's ear, the casing defining a driver-locating cavity or chamber at least a portion of which is cylindrical, a driver with a diaphragm located within the cylindrical portion of the chamber, so there is a rear cavity behind the driver, and a front cavity in front of the driver, wherein the front cavity communicates with a front outlet duct adapted to provide sound to the user's ear, the front outlet duct defining a front restrictive duct portion with a cross-sectional area less than that of the diaphragm, and the rear cavity communicates with a rear outlet duct which defines a rear restrictive duct portion with a cross-sectional area less than that of the diaphragm; wherein the rear outlet duct, the cylindrical portion of the chamber, and the front outlet duct are coaxial, so the rear outlet duct and the front outlet duct are aligned with each other, the front restrictive duct portion and the rear restrictive duct portion having the same cross-sectional area.

Preferably the driver is clamped with a resilient element that engages with its front face near the periphery, the resilient element being compressed between the driver and the end face of the front cavity. There may also be a resilient element that engages with the rear face of the driver near the periphery, so the driver is clamped between two such resilient elements. The resilient elements may comprise O-rings or gaskets to provide resilience.

In each aspect of the invention, at least one resilient element may combine an item that is rigid with an item that is resilient, so as to provide greater axial length. Hence an O-ring or gasket may be in contact with a face of the driver, or may be spaced apart by a rigid element, such as a metal ring or washer, from the face of the driver. The driver may effectively be sealed to the casing by at least one of the resilient elements. The resilient elements ensure that the driver as a whole does not vibrate or rattle in the casing.

In each aspect of the invention, the driver may be spaced apart from the opposite end of the front cavity by a compressed seal, so that the thickness of the compressed seal defines the depth of the front cavity. In each type of casing it will be appreciated that the electrical connection to a driver may be made using a cable guide as described above.

The restrictive duct portion, in each case, is the portion of the outlet duct of the least cross-sectional area. The sound outlet duct desirably has a wider portion at the end closest to the driver, tapering down to the restrictive duct portion, so as to efficiently couple sound from the entire width of the diaphragm into the restrictive duct portion. This may have a linear taper. The restrictive duct portion may have a cross-sectional area between 20% and 29% of the cross-sectional area of the diaphragm. The sound outlet duct may also have a widening portion at the end furthest from the driver.

The rear outlet duct and the front outlet duct, where both such outlet ducts are provided, or the sound outlet duct where there is only one such outlet duct, are typically defined by surfaces each of which is a surface of revolution about the longitudinal axis of a cylindrical portion of the driver-locating cavity. In each case they may be cylindrical, or they may vary in diameter along their length, for example having a linear or bell-shaped taper at one end or at each end. Where the or each outlet duct communicates with the driver-locating cavity there is desirably a tapered transition, which may for example be inclined at between 40° and 50°, for example at 45°, to a longitudinal axis of the outlet duct. In each case the restrictive duct portion may have a linear taper, or a bell-shaped taper. There may also be a widening portion at the end furthest from the driver.

In an embodiment in which there is both a rear outlet duct and a front outlet duct, the rear cavity may also be less than 3 mm deep and preferably no more than 2 mm deep. As with the front cavity, the driver is spaced apart from the end of the rear cavity by the compressed seal, so that the thickness of the compressed seal may define the depth of the rear cavity. The rear cavity may be of the same depth as the front cavity, or may be less deep than the front cavity. As mentioned previously, it will be appreciated that the driver typically has at least one vent hole behind the diaphragm, which communicates with the rear cavity; the rear cavity is therefore in communication with the free space within the driver but behind the diaphragm. It is usually necessary to make electrical contact at the rear of the driver, so it is typically advantageous to provide a rear cavity which is at least sufficiently deep to accommodate the requisite electrical connections. The rear outlet duct desirably has a wider portion at the end closest to the driver, tapering down to the restrictive duct portion, so as to couple sound from the rear of the driver efficiently into the restrictive duct portion. The restrictive duct portion may have a linear taper, or a bell-shaped taper. The rear outlet duct may also have a widening portion at the end furthest from the driver.

In one embodiment the front outlet duct and the rear outlet duct have the same longitudinal profile.

It appears that the provision of symmetrically located outlet ducts in front and at the rear of the driver has a beneficial effect on the operation of the driver, ensuring a more consistent response over the entire audible frequency range, for example between 20 Hz and 20 kHz.

In each aspect of the invention, the casing must be substantially rigid in operation, so that the driver is held securely in position and the casing does not vibrate. The casing may for example be of aluminium, stainless steel or titanium, although other materials may also be suitable. The driver may be supported within the casing by two opposed seals, as mentioned above. In embodiments where there is an airtight cavity behind the driver, then this feature and also the rigid casing would ensure that no sound comes out from the rear of the headphone or earphone.

In the case of a headphone, the casing would typically be supported by a strap over the user's head, and may be provided with ear cushions or foam pads. In the case of an earphone, the casing would typically be provided with a foam bud or earphone tip to seal to the ear canal, as is commonly used with earphones.

The invention will now be further and more particularly described, by way of example only, and with reference to the accompanying drawings, in which.

Figure 1:
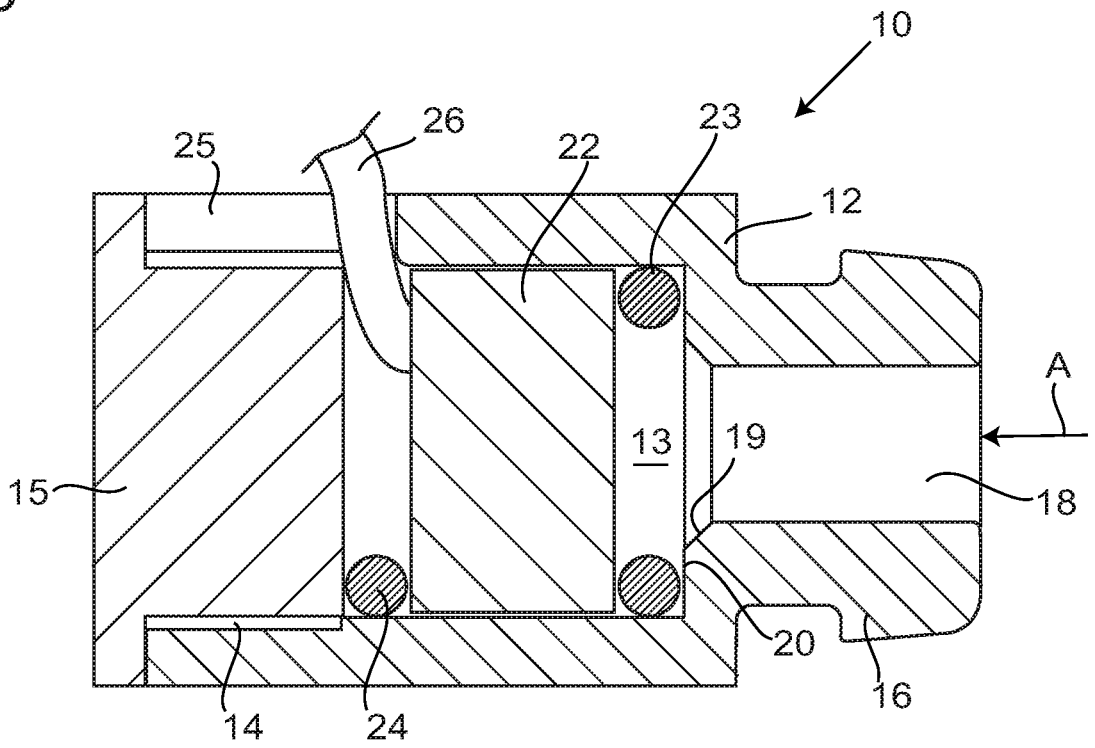
FIG. 1 shows a longitudinal sectional view through an earphone of the invention.

Referring to FIG. 1 an earphone 10 comprises a generally cylindrical titanium casing 12 of external diameter 7.0 mm that defines an internal cylindrical chamber 13 of internal diameter 5.1 mm. At one end the casing 12 defines an internally threaded portion 14, and a threaded plug 15 engages this threaded portion 14 and blocks that end of the chamber 13. At the other end the casing 12 defines an projecting portion 16 of smaller external diameter, and this projecting portion 16 defines an axial bore 18 of internal diameter 2.2 mm that communicates via a short tapered portion 19 with the internal cylindrical chamber 13, so there is an internal step 20 at that end of the chamber 13.

Within the cylindrical chamber 13 is an acoustic driver 22 which is clamped between two O-rings 23 and 24: one O-ring 23 is between the front face of the driver 22 and the internal step 20, while the other O-ring 24 is between the rear face of the driver 22 and the threaded plug 15. Each O-ring 23 and 24 is 1 mm think, and defines a central aperture of diameter 3 mm. In this example there is a slot 25 through the casing wall along the length of the threaded portion 14, and an electric cable 26 which is connected to the driver 22 projects through a corresponding gap cut in the O-ring 24 and through the end of the slot 25. In a modification the slot 25 might not be provided, and instead the electric cable might pass through a hole in the centre of the threaded plug 15.

The acoustic driver 22 includes a diaphragm (not shown), and is a dynamic driver, that is to say the diaphragm is moved by a voice coil in the field of a permanent magnet. The diaphragm is near the front face of the driver 22, being protected by a perforated metal cover. Such drivers are known, and for example one such driver is manufactured by Shenzhen BTX Electronics Co Ltd. The diaphragm in this case has a diameter of 4.47 mm. The driver 22 also includes a protective cover around the rear of the diaphragm, the protective cover including at least one perforation. It will be appreciated that the driver may be of a different type, for example a balanced armature type, a planar magnetic type or an electrostatic type; and that the size of the driver and of its diaphragm may differ from that described here.

It will thus be appreciated that the earphone 10 can be assembled by inserting the O-ring 23 into the cylindrical chamber 13, and then inserting the driver 22 with the electric cable 26 projecting through the slot 25. The O-ring 23 does not obstruct any of the perforations of the driver's perforated metal cover. The O-ring 24 is then placed in position, with the electric cable 26 passing through a corresponding-sized gap cut in the O-ring 24, and the threaded plug 15 is then screwed tightly into position. The driver 22 is securely and firmly held between the two compressed O-rings 23 and 24. The portion of the cylindrical chamber 13 behind the driver 22, that is to say between the driver 22 and the threaded plug 15, is rendered airtight by the compression of the O-ring 24 and of the cable 26. The depth of this airtight space is therefore the merely the thickness of the compressed O-ring 24, which in this case is 1.0 mm; and the diameter of the airtight space is approximately the internal diameter of the O-ring 24, which is 3 mm.

In use of the earphone 10 the projecting portion 16 would be provided with a foam earbud, for example a memory foam earbud (not shown), and inserted into the ear canal of the user, so that the axial bore 18 is directly connected to the user's ear canal. The sound emerging from the front face of the driver 22 passes through the space defined by the internal diameter of the O-ring 23, and then through the short tapered portion 19 into the axial bore 18, which is coupled to the user's ear at the other end. The axial bore 18 is clearly the narrowest part of the path followed by the sound emerging from the earphone 10, and so acts as a restrictive duct portion. The provision of this restrictive duct portion, by the provision of the axial bore 18, has been found to achieve a greatly improved frequency response of the driver 22, as it can operate linearly over the entire audible range between 20 Hz and 20 kHz.

Figure 3:
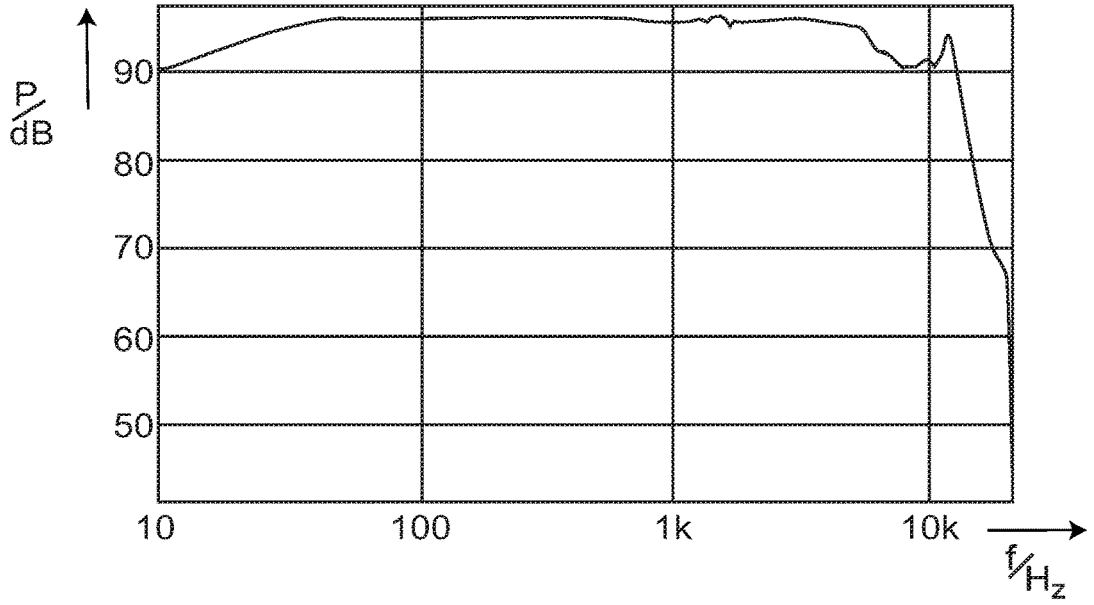
FIG. 3 shows a graphical representation of experimental measurements of the variation of sound pressure level with frequency for the earphone of FIG. 1.

Referring now to FIG. 3, this shows graphically experimental test data for the variation of sound pressure level, P, in decibels, with frequency f (smoothed over ¼8 of an octave), with the earphone 10 described above. These measurements were taken by sealing the earphone 10 directly to a microphone. The test equipment does not give entirely satisfactory measurements above 16 kHz; more accurate measurements might be obtainable using a test head. Nevertheless from the graph it is clear that the sound pressure level P is substantially consistent over a wide range of audible frequencies f.

It has been found that the earphone 10 can provide a linear response over the entire audible frequency range, without any waveform distortion. Not only is the sound generated more accurately, it has been found that the earphone 10 is more comfortable for prolonged wear, and that the users report that their ears feel fresh even after listening to the earphone 10 all day.

It will also be appreciated that the invention is equally applicable to a headphone. In this case the driver and the casing would typically be significantly larger, for example the driver being of diameter 25 mm, 35 mm or 50 mm, and the casing being of larger diameter, typically between 3 and 6 mm larger. As indicated above, the casing must define a restrictive duct portion equivalent to the axial bore 18, whose cross-sectional area is between 19% and 30% of the diaphragm's cross-sectional area. For a particular driver and diaphragm the optimum size of the restrictive duct portion can be found by experiment, but is typically between 20% and 28% of the diaphragm's cross-sectional area and so is of diameter typically between 0.45 and 0.53 times that of the diaphragm. For example, for a driver of diameter 35 mm with a diaphragm of diameter 33 mm, for example, typically the restrictive duct portion would be of diameter between 14.8 mm and 17.5 mm.

Figure 4:
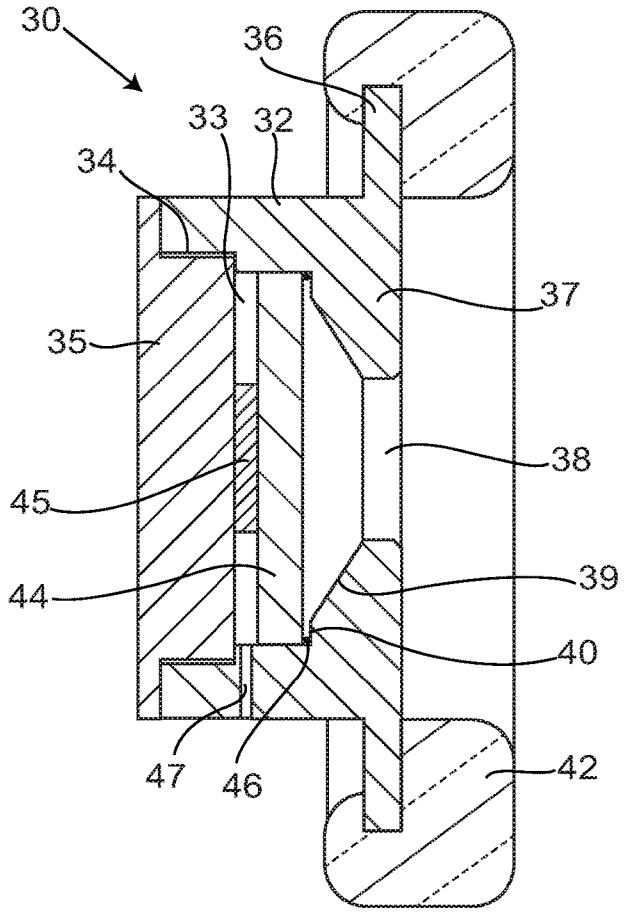
FIG. 4 shows a longitudinal sectional view through a headphone of the invention.

Referring now to FIG. 4, such a headphone 30 is shown in sectional view. The headphone 30 comprises a generally cylindrical aluminium casing 32 of external diameter 50 mm that defines an internal cylindrical chamber 33 of internal diameter 40.5 mm. At one end the casing 32 defines an internally threaded portion 34, and a threaded plug 35 engages this threaded portion 34 and blocks that end of the chamber 33. At the other end, the casing 32 defines an external flange 36 and an internal flange 37 defining a cylindrical aperture 38 of internal diameter 17.0 mm. The inner face of the internal flange 38 has a tapered portion 39, and also defines an internal step 40 at that end of the chamber 33. A ring-shaped ear cushion 42 of a soft resilient material is mounted onto the external flange 36, and comes up against the side of the user's head in use of the headphone 30.

Within the cylindrical chamber 33 is an acoustic driver 44 that is of a generally flat cylindrical shape, of external diameter 40 mm, but which incorporates a cylindrical magnet 45 which projects from its rear face. The threaded plug 35 pushes against the cylindrical magnet 45, while an O-ring 46 is compressed between the front face of the driver 44 and the internal step 40. The O-ring 46 is 1 mm thick, and of external diameter 40 mm, so it is adjacent to the periphery of the front face of the driver 44. In this example there is a hole 47 through the casing wall and communicating with the cylindrical chamber 33 behind the rear face of the driver 44, through which an electric cable (not shown) may pass, for electrical connection to the driver 44.

Although the O-ring 46 is shown as being a separate component, it may alternatively form a projecting rim on the front face of the acoustic driver 44. The acoustic driver 44 includes a diaphragm (not shown), and is a dynamic driver, that is to say the diaphragm is moved by a voice coil in the field of the magnet 45. The diaphragm is near the front face of the driver 44, being protected by a perforated metal cover. The diaphragm in this case has a diameter of 35 mm. The driver 44 also includes a protective cover around the rear of the diaphragm, the protective cover including at least one perforation. It will be appreciated that the driver may be of a different type, for example a balanced armature type, a planar magnetic type, or an electrostatic type; and that the size of the driver and of its diaphragm may differ from that described here.

The headphone 30 can be assembled by inserting the O-ring 46 into the cylindrical chamber 33, if it is a separate component, and then inserting the driver 44, and then introducing an electric cable through the hole 47 and connecting the electric cable to the driver 44. The O-ring 46 does not obstruct any of the perforations of the driver's perforated metal cover. The threaded plug 35 is inserted and tightened. The portion of the cylindrical chamber 33 behind the driver 44, that is to say between the driver 44 and the threaded plug 35, is rendered airtight by the compression of the O-ring 46. The depth of this airtight space is the thickness of the projecting part of the magnet 45, which in this case is 2 mm.

In use of the headphone 30 the ear cushion 42 inhibits leakage of sound, so the sound is provided to the user's ear. The sound emerging from the front face of the driver 44 must pass through the tapering space defined by tapered portion 39 of the internal flange 37, and then through the cylindrical aperture 38. This cylindrical aperture 38 is clearly the narrowest part of the path followed by the sound emerging from the headphone 30 and so acts as a restrictive duct portion, so providing the same advantages as described above, of a more uniform and consistent sound output over the audible frequency range. It is presumed that this improvement occurs because the pressure changes in the cavities in front of the diaphragm and behind the diaphragm, arising as a consequence of the restrictive duct portion 38 in front and the airtight cavity behind the driver 44, counteract each other.

In a modification to the headphone 30 the magnet 45 does not come into contact with the plug 35, and instead there is an O-ring (not shown) compressed between the rear face of the driver 44 and the face of the plug 35 near its periphery, this O-ring defining a notch or gap aligned with the hole 47 for passage of the cable.

The embodiments described above include an airtight rear cavity. Alternative embodiments define an axial rear outlet duct communicating with the rear cavity, and are described below. Many of the features are identical to those described above, and are referred to by the same reference numerals.

Figure 2:
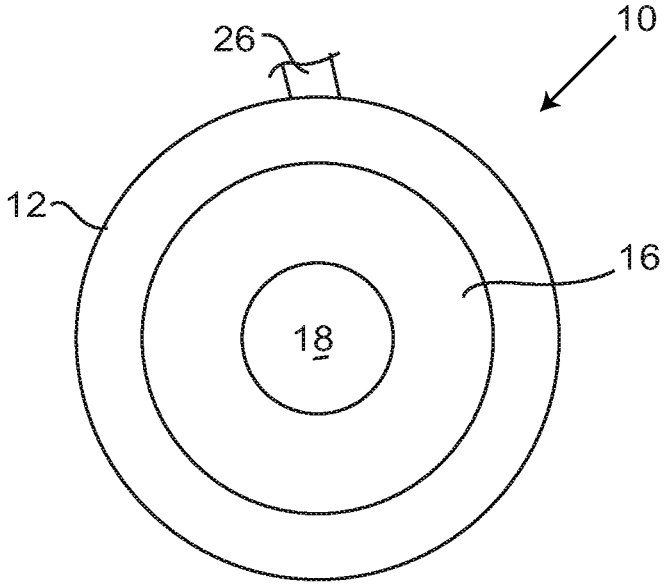
FIG. 2 shows an end view of the earphone in the direction of arrow A of FIG. 1.
Figure 5:
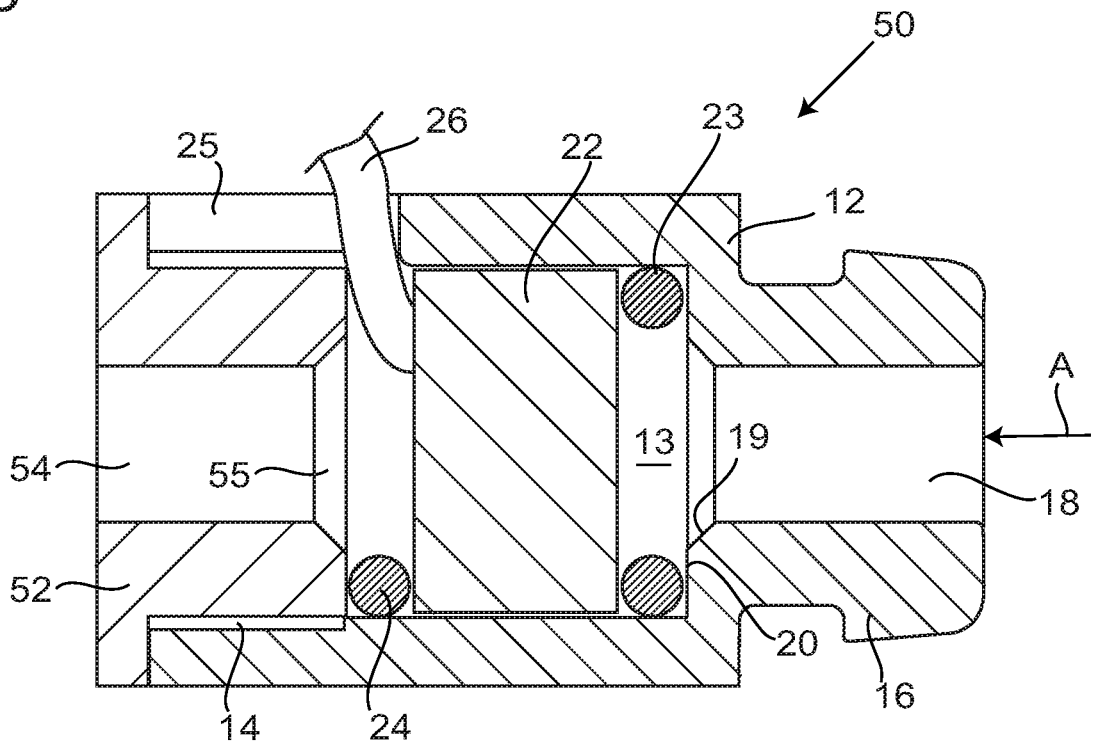
FIG. 5 shows a longitudinal sectional view through an alternative earphone of the invention.

Referring to FIG. 5 an earphone 50 comprises a generally cylindrical titanium casing 12 of external diameter 7.0 mm that defines an internal cylindrical chamber 13 of internal diameter 5.1 mm. At one end the casing 12 defines an internally threaded portion 14, and a threaded plug 52 engages this threaded portion 14. The threaded plug 52 defines an axial bore 54 of internal diameter 2.2 mm that communicates via a short tapered portion 55 with the internal cylindrical chamber 13. At the other end the casing 11 defines an projecting portion 16 of smaller external diameter, and this projecting portion 16 defines an axial bore 18 of internal diameter 2.2 mm that communicates via a short tapered portion 19 with the internal cylindrical chamber 13. The widest end of each short tapered portion 55 and 19 is 2.6 mm. There is therefore an internal step 20 at the front end of the chamber 12. It will be appreciated that a view of the earphone 50 in the direction of arrow A is identical to that shown in FIG. 2.

Within the cylindrical chamber 13 is an acoustic driver 22 which is clamped between two 0-rings 23 and 24, one O-ring 23 is between the front face of the driver 22 and the internal step 20, while the other O-ring 24 is between the rear face of the driver 22 and the face of the threaded plug 52 that surrounds the short tapered portion 55. Each O-ring 23 and 24 is 1 mm thick, and defines a central aperture of diameter 3 mm. There is a slot 25 through the casing wall along the length of the threaded portion 14, and an electric cable 26 which is connected to the driver 22 projects through a corresponding gap cut in the O-ring 24 and through the end of the slot 25.

The acoustic driver 22 includes a diaphragm (not shown), and is a dynamic driver, that is to say the diaphragm is moved by a voice coil in the field of a permanent magnet. The diaphragm is near the front face of the driver 22, being protected by a perforated metal cover. The diaphragm in this case has a diameter of 4.47 mm. The driver 22 also includes a protective cover around the rear of the diaphragm, the protective cover including at least one perforation. It will be appreciated that the driver may be of a different type, for example a balanced armature type, a planar magnetic type or an electrostatic type; and that the size of the driver and of its diaphragm may differ from that described here.

It will thus be appreciated that the earphone 50 can be assembled by inserting the O-ring 23 into the cylindrical chamber 13, and then inserting the driver 22 with the electric cable 26 projecting through the slot 25. The O-ring 23 does not obstruct any of the perforations of the driver's perforated metal cover. The O-ring 24 is then placed in position, with the electric cable 26 passing through a corresponding-sized gap cut in the O-ring 24, and the threaded plug 52 is then screwed tightly into position. The driver 22 is securely and firmly held between the two compressed O-rings 23 and 24. Any pressure fluctuations or sound waves in the portion of the cylindrical chamber 13 behind the driver 22, that is to say between the driver 22 and the threaded plug 52, can propagate through the axial bore 54; and equally the sound waves produced by the driver 22 in the portion of the cylindrical chamber 13 in front of the driver 22 propagate through the axial bore 18 into the user's ear.

It will be understood that the O-ring 23 and the O-ring 24 may have a non-circular cross-sectional shape (in an axial section, as shown). For example they may be replaced by neoprene rubber washers or gaskets, as long as the radial width of the washer or gasket is not so great as to obstruct a significant portion of the face of the driver 22, and in this case the cross-sectional shape on each side would be square or rectangular. Other materials are also suitable, such as moulded silicone.

In use of the earphone 50 the projecting portion 16 would be provided with a foam earbud, for example a memory foam earbud (not shown), and inserted into the ear canal of the user, so that the axial bore 18 is directly connected to the user's ear canal. The sound emerging from the front face of the driver 22 passes through the space defined by the internal diameter of the O-ring 23, and then through the short tapered portion 19 into the axial bore 18, which is coupled to the user's ear at the other end. The axial bore 18 is clearly the narrowest part of the path followed by the sound emerging from the earphone 50, and so acts as a restrictive duct portion. Similarly the axial bore 54 is the narrowest part of the path for any sound propagating from the back of the driver 22, and so acts as a restrictive duct portion. The axial bores 54 and 18 are aligned with each other, as they are both coaxial with the cylindrical chamber 13, and they are of the same diameter. The provision of the two axially-aligned restrictive duct portions of the same diameter has been found to achieve an improved frequency response of the driver 22, as it can operate linearly over the entire audible range between 20 Hz and 20 kHz.

It will be appreciated that the earphones 10 and 50 described above can be modified in various ways. For example the casing 12 may be of a different material, such as aluminium, or of a rigid non-metallic material such as an engineering plastic. The dimensions are also given only by way of example. The slope and length of the tapered portion 19 may differ from that shown; and the step 20 may be of a different size, for example being no larger than the thickness of the O-ring 23. Evidently the diameter of the internal cylindrical chamber 13 must be such as to fit the size of the driver 22, so with a larger driver the internal diameter of the chamber would also be correspondingly larger.

It will also be appreciated that in the earphone 10 or 50 described above, the thickness of the O-rings 23 and 24 determines the distance between the face of the driver 22 and the corresponding end face of the internal chamber 13. If a greater distance between the face of the driver 22 and the end face of the internal chamber 13 is required, this can either be achieved by using a thicker O-ring, or by combining an O-ring 23, 24 with another ring-shaped item, for example a second O-ring, or a ring of rigid material. In each case each O-ring may be replaced by a rubber washer or gasket.

It has been found that the earphone 50 can provide a linear response over the entire audible frequency range, without any waveform distortion. Not only is the sound generated more accurately, it has been found that the earphone 50 is more comfortable for prolonged wear, and that the users report that their ears feel fresh even after listening to the earphone 50 all day; users have reported less ear fatigue even with all day use.

It will also be appreciated that the invention is equally applicable to a headphone. In this case the driver and the casing would typically be significantly larger, for example the driver being of diameter 25 mm, 35 mm or 50 mm, and the casing being of larger diameter, typically between 3 and 6 mm larger. As indicated above, the casing must define a restrictive duct portion equivalent to the axial bore 54, and an aligned restrictive duct portion equivalent to the axial bore 18.

Figure 6:
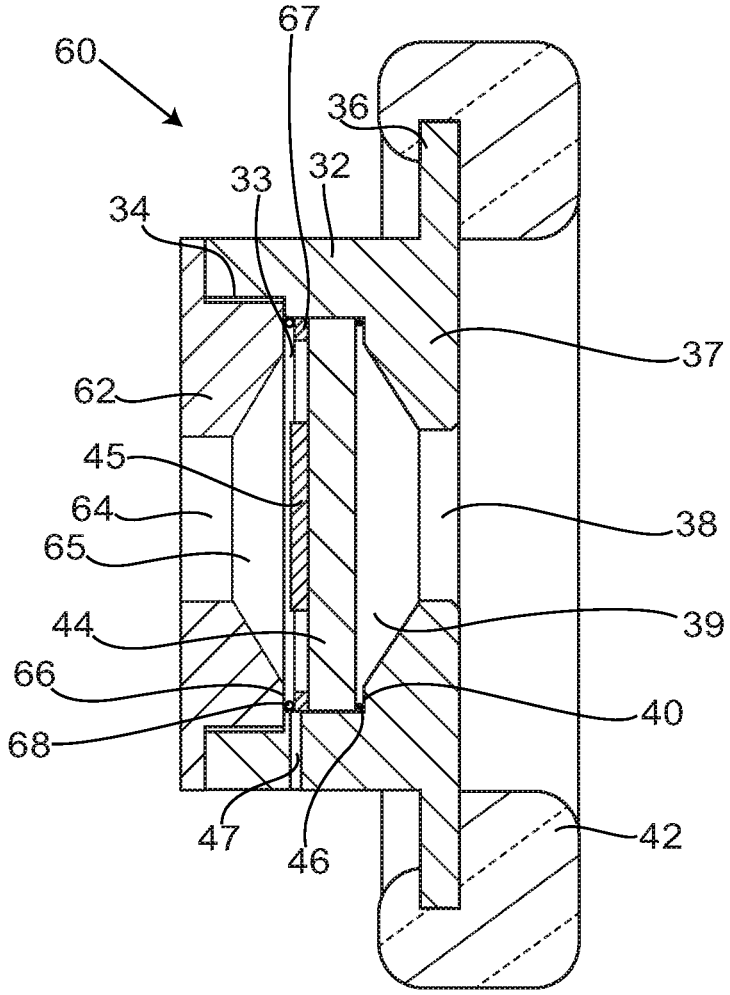
FIG. 6 shows a longitudinal sectional view through an alternative headphone of the invention.
Figure 8:
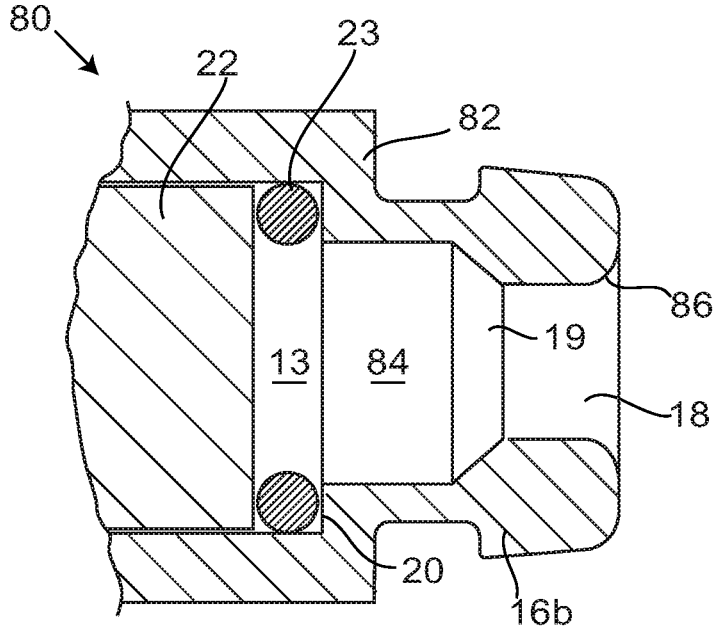
FIG. 8 shows a longitudinal sectional view through an alternative modification to a casing for an earphone.

Referring now to FIG. 6, such a headphone 60 is shown in sectional view. The headphone 60 comprises a generally cylindrical aluminium casing 32 of external diameter 50 mm that defines an internal cylindrical chamber 33 of internal diameter 40.5 mm. At one end the casing 32 defines an internally threaded portion 34, and a threaded plug 62 engages this threaded portion 34. At the other end, the casing 32 defines an external flange 36 and an internal flange 37. The inner face of the internal flange 37 tapers to define a tapering duct portion 39, and also defines an internal step 40 at that end of the chamber 33. The tapering duct portion 39 communicates with a cylindrical aperture or bore 38 of internal diameter 17.0 mm. A ring-shaped ear cushion 42 of a soft resilient material is mounted onto the external flange 36, and comes up against the side of the user's head in use of the headphone 60. The cylindrical aperture or bore 38 is coaxial with the internal cylindrical chamber 33.

The threaded plug 62 defines a cylindrical aperture or bore 64 of internal diameter 17.0 mm which communicates with a tapered portion 65 leading into the cylindrical chamber 33, and there is an annular face 66 surrounding the open end of the tapered portion 65, next to the periphery of the threaded plug 62. The tapered portion 65 has the same dimensions as the tapering duct portion 39; and the cylindrical aperture or bore 64 is aligned with the cylindrical aperture 38.

Within the cylindrical chamber 33 is an acoustic driver 44 that is of a generally flat cylindrical shape, of external diameter 40 mm, but which incorporates a cylindrical magnet 45 which projects from its rear face. A metal ring 67 that is also of external diameter 40 mm locates behind the acoustic driver 44, and an O-ring 68 is compressed between the rear surface of the driver 44 and the annular face 66 on the threaded plug 62. Similarly, an O-ring 46 is compressed between the front face of the driver 44 and the internal step 40. The O-rings 46 and 68 are each 1 mm thick, and of external diameter 40 mm, so they are adjacent to the periphery of the cylindrical chamber 33. In this example there is a hole 47 through the casing wall and communicating with the cylindrical chamber 33 behind the rear face of the driver 44, through which an electric cable (not shown) may pass, for electrical connection to the driver 44. Although the O-ring 46 is shown as being a separate component, it may alternatively form a projecting rim on the front face of the acoustic driver 44.

Although the O-ring 46 is shown as being a separate component, it may alternatively form a projecting rim on the front face of the acoustic driver 44. Similarly, although the O-ring 68 is shown as being a separate component, it may alternatively form a projecting resilient rim on the face of the metal ring 67. The acoustic driver 44 includes a diaphragm (not shown), and is a dynamic driver, that is to say the diaphragm is moved by a voice coil in the field of the magnet 45. The diaphragm is near the front face of the driver 44, being protected by a perforated metal cover. The diaphragm in this case has a diameter of 35 mm. The driver 44 also includes a protective cover around the rear of the diaphragm, the protective cover including at least one perforation. It will be appreciated that the driver may be of a different type, for example a balanced armature type, a planar magnetic type, or an electrostatic type; and that the size of the driver and of its diaphragm may differ from that described here.

The headphone 60 can be assembled by inserting the O-ring 46 into the cylindrical chamber 33, if it is a separate component, and then inserting the driver 44, and then introducing an electric cable through the hole 47 and connecting the electric cable to the driver 44. The O-ring 46 does not obstruct any of the perforations of the driver's perforated metal cover. The metal ring 67 and the O-ring 68 are then inserted, the metal ring 67 defining a groove (not shown) through which the electric cable passes. The threaded plug 62 is then inserted and tightened so that the O-rings 46 and 68 are compressed.

In use of the headphone 60 the ear cushion 42 inhibits leakage of sound, so the sound is provided to the user's ear. The sound emerging from the front face of the driver 44 must pass through the tapering duct portion 39 and then through the cylindrical aperture or bore 38. Similarly, any pressure waves or sound emerging from the rear face of the driver 44 must pass through the tapered portion 65 and the cylindrical aperture or bore 64. The cylindrical apertures 38 and 64 are clearly the narrowest parts of the paths followed by the sound emerging from the headphone 60 and so act as restrictive duct portions, so providing the same advantages as described above, of a more uniform and consistent sound output over the audible frequency range.

It will be appreciated that the distance between the front face of the driver 44 and the internal step 40 at the end of the cylindrical chamber 33 is determined by the thickness of the O-ring 46. The distance between the rear face of the periphery of the driver 44 and the annular face 66 on the threaded plug 62 is somewhat greater, because it is determined by the thickness of the combination of the metal ring 67 and the O-ring 68. In one modification the metal ring 67 may be omitted, so reducing the distance between the rear face of the periphery of the driver 44 and the threaded plug 62; in this modification the cylindrical magnet 45 would project slightly into the tapered portion 65. In another modification a second ring 67 may be inserted adjacent to the O-ring 46, so increasing the distance between the front face of the driver 44 and the end of the cylindrical chamber 33. And as with the earphones 10 and 50 described above, the O-rings 46 and 68 may be replaced by rubber gaskets or washers. Indeed, in each case where an O-ring is described, it may be replaced by a rubber gasket or washer, for example a flat washer or gasket of a rubber-replacement material such as moulded silicone, for example of thickness typically between 0.3 mm and 5 mm, for example 0.5 mm.

In both the earphone 50 and the headphone 60 it has been found that the sound quality is enhanced by the provision of the two aligned outlets of the same diameter that are coaxial with the driver: the axial bores 54 and 18 in the earphone 50, and the cylindrical apertures 64 and 38 in the headphone 60. In contrast, if for example the rear outlet (i.e. the axial bore 54 or the cylindrical aperture 64) is not coaxial with the cylindrical chamber 13 or 33, this produces much poorer sound quality. It is surmised that a non-axial outlet leads to an asymmetrical pressure distribution over the driver, which is detrimental to the sound quality.

Figure 7:
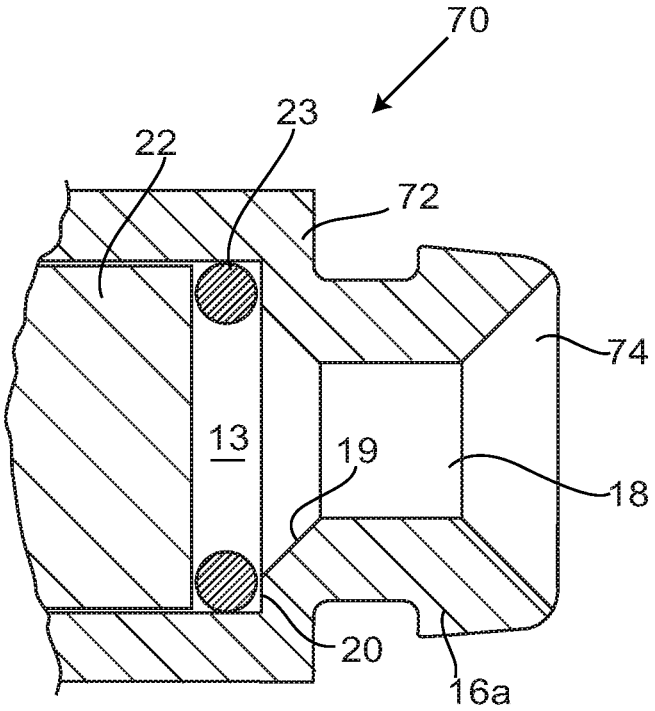
FIG. 7 shows a longitudinal sectional view through a modification to a casing for an earphone.

In the earphones 10 and 50 the projecting portion 16 defines a sound outlet duct with a short tapered portion 19 leading to the axial bore 18. The angle of taper, relative to the longitudinal axis of the bore 18, is preferably between 40° and 50°, and in both these cases is 45°. Referring now to FIG. 7, this shows a partial view of a casing 72 for an earphone 70, differing only from the casing 12 in having a modified projecting portion **16*a*, in which the short tapered portion 19 is significantly longer than shown above, although again it is at an angle of taper 45°. At the outer end of the projecting portion 16***a* the axial bore 18 opens out into a widening portion 74 which also has a linear taper at an angle of 45° to the axis; consequently the axial bore 18 is correspondingly shorter.

Although the sound outlet duct desirably includes a tapered portion, this may shows a partial view of a casing 82 for an earphone 80, differing only from the casing 12 in having a modified projecting portion 16*b*, in which there is a cylindrical portion 84, followed by a short tapered portion 19 that leads to the axial bore 18; and at the outer end the axial bore 18 communicates with a short longitudinally-curved flared portion 86. The tapered portion 19 has a linear taper at an angle of 45° to the axis. This shape of the sound outlet duct would be equally suitable in a rear outlet duct in the plug 52 as shown in the earphone 50.

Figure 9:
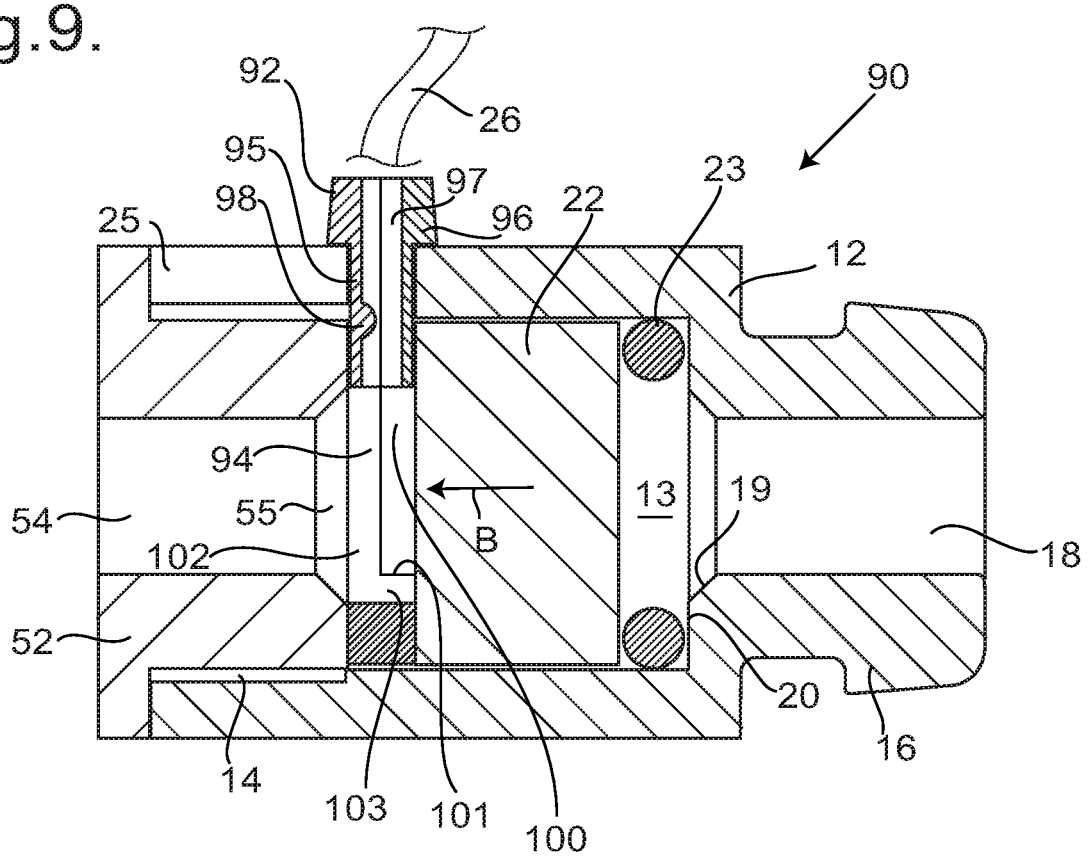
FIG. 9 shows a sectional view through a modification to the earphone of FIG. 5.

Referring now to FIG. 9 there is shown an earphone 90 which in most respects is identical to the earphone 50 of FIG. 5, identical features being referred to by the same reference numerals. The only difference is that instead of providing an O-ring seal 24 with a gap for the cable 26, the cable 26 is instead fed through a cable guide 92 formed of nylon. For clarity the cable 26 is not shown within the cable guide 92.

Figure 10:
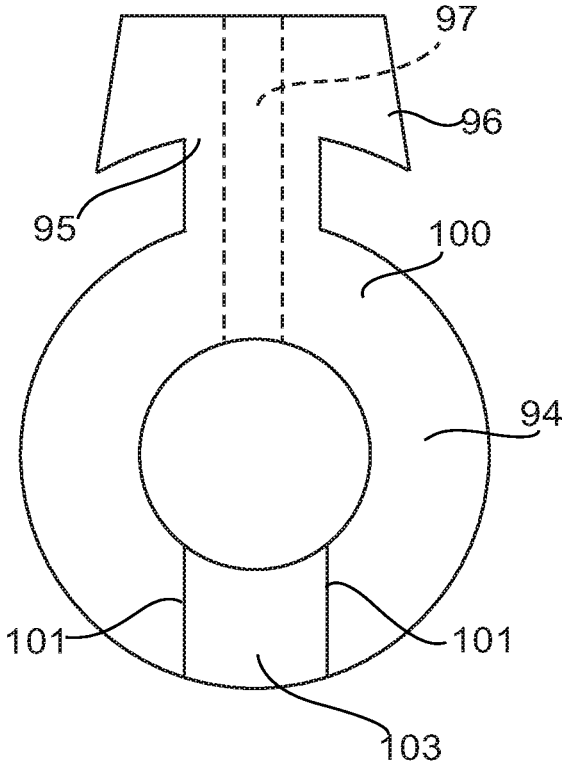
FIG. 10 shows a view in the direction of arrow B of FIG. 9, showing only the cable guide.

Referring to FIGS. 9 and 10, the cable guide 92 defines a clamping ring 94 that fits coaxially within the cylindrical cavity 13 behind the driver 22, from which a stud 95 projects radially, the stud 95 fitting through the slot 25 and having a larger portion 96 which fits against the outer surface of the cylindrical casing 12. An inlet duct 97 extends throughout the length of the stud 95 and through the adjacent part of the clamping ring 94. At an intermediate position within the inlet duct 97 the left-hand wall (as shown in FIG. 9) defines a projecting rounded hump 98. Hence the cable 26 can extend through the inlet duct 97 and through the middle of the ring 94 to reach the rear of the driver 22, and is clamped by friction with the rounded hump 98.

The cable guide 92 is of two mating parts: a first part 100 that defines one side (the right-hand side as shown in FIG. 9) of the inlet duct 97 and defines an arcuate portion of one face (the right-hand face as shown in FIG. 9) of the clamping ring 94, but defining a circumferential gap between ends 101 (only one of which is shown in FIG. 9) of the arcuate portion; and a second part 102 that defines the other side of the inlet duct 97, and also defines the remainder of the clamping ring 94, including a projecting part 103 which fits into the circumferential gap between the ends 101. When the two parts 100 and 102 are put together the clamping ring 94 hence has a substantially continuous front face and a substantially continuous rear face.

Hence during assembly the wires in the cable 26 may be soldered to terminals at the rear of the driver 22. The cable 26 is then laid into the right-hand side (as shown in FIG. 9) of the inlet duct 97, defined by the first part 100 of the cable guide 92 so the two ends 101 of the arcuate portion project on opposite sides of the cable 26. The second part 102 of the cable guide 92 is then put together with the first part 100, so the projecting part 103 fits between the two ends 101 of the arcuate portion to complete the right-hand face (as shown in FIG. 9) of the clamping ring 94, and the cable 26 is then squeezed and clamped by the projecting hump 98. The threaded plug 52 is then screwed into the threaded portion 14 so the clamping ring 94 is compressed between the front face of the plug 52 and the rear face of the driver 22. The clamping ring 94 provides substantially uniform compression around the entire periphery of the rear face of the driver 22.

What is claimed is:

1. A headphone or earphone consisting of a casing adapted to fit to a user's ear, the casing defining a cavity to locate a driver and also defining a sound outlet duct that communicates with a front end of the cavity to provide sound to the user's ear, the sound outlet duct being of less width than the driver and defining a restrictive duct portion which is that portion of the sound outlet duct that has a cross-sectional area, and the casing being provided with a rear closure element, the casing enclosing the driver with a diaphragm at a front face of the driver, so that the driver divides the cavity into a rear cavity behind the driver and a front cavity in front of the driver, wherein the front cavity communicates with the sound outlet duct; and also comprising at least one resilient element, such that the driver is clamped between the resilient element that engages with its front face near a periphery and a rear resilient element that engages a rear face of the driver, the resilient element that engages the front face being compressed between an end face of the front cavity and the front face of the driver, wherein the rear cavity defines a rear outlet duct that is axially aligned with the sound outlet duct and that defines a rear restrictive duct portion having a same cross-sectional area as the restrictive duct portion of the sound outlet duct.

2. A headphone or earphone as claimed in claim 1 wherein the rear element is also a resilient element, and engages the rear face of the driver near its periphery.

3. A headphone or earphone as claimed in claim 2 wherein the resilient elements are O-ring seals or gaskets.

4. A headphone or earphone as claimed in claim 1 wherein the rear closure element is connected to the casing by a threaded connection.

5. A headphone or earphone as claimed in claim 4 wherein the rear closure element fits at least partly within an end portion of the cavity, and the threaded connection comprises a screw thread on an inside wall of the end portion of the cavity.

6. A headphone or earphone as claimed in claim 1 wherein the sound outlet duct comprises a tapered duct portion that is widest at an end closest to the driver, and that tapers down to the restrictive duct portion.

7. A headphone or earphone as claimed in claim 6 wherein the tapered duct portion had a linear taper inclined at between 40° and 50° to a longitudinal axis of the sound outlet duct.

8. A headphone or earphone as claimed in claim 1 wherein the sound outlet duct defines the restrictive duct portion with the cross-sectional area between 19% and 30% of a cross-sectional area of the diaphragm.

9. A headphone or earphone as claimed in claim 1 wherein the rear outlet duct defines a wider portion at an end closest to the driver, tapering down to the rear restrictive duct portion.

10. A headphone or earphone as claimed in claim 9 wherein the sound outlet duct and the rear outlet duct have a same longitudinal profile in the a direction leading away from the driver.

11. A headphone or earphone as claimed in claim 10 wherein both the sound outlet and the rear outlet duct have a widening portion at an end furthest from the driver.

12. A headphone or earphone as claimed in claim 1 wherein at least one resilient element combines a first item that is rigid with a second item that is resilient, so as to provide greater axial length.

13. A headphone or earphone wherein a casing defines a cylindrical cavity with a wall that defines a slot for entry of a cable for connection to a driver, and also comprising a cable guide, the cable guide defining an inlet duct that can locate in the slot, and a clamping ring that fits coaxially within the cylindrical cavity, wherein the capable guide comprises two mating parts: a first part that defines one side of the inlet duct and defines an arcuate portion of the face of the clamping ring so as to define a circumferential gap between ends of the arcuate portion; and a second part that defines another side of the inlet duct, and also defines the remainder of the clamping ring, such that when the two parts are put together the clamping ring has a substantially continuous front face and a substantially continuous rear face.

14. A headphone or earphone as claimed in claim 13 wherein the second part of the cable guide defines a ring that forms the rear face of the clamping ring, from which projects the arcuate portion that fits in the circumferential gap between the ends of the arcuate portion of the first part of the cable guide.

15. A headphone or earphone consisting of a casing adapted to fit to a user's ear, the casing defining a driver-locating cavity or chamber at least a portion of which is cylindrical, a driver with a diaphragm located within the cylindrical portion of the chamber, so there is a rear cavity behind the driver, and a front cavity in front of the driver, wherein the front cavity communicates with a front outlet duct adapted to provide sound to the user's ear, the front outlet duct defining a front restrictive duct portion with a cross-sectional area less than that of the diaphragm, and the rear cavity communicates with a rear outlet duct which defines a rear restrictive duct portion with a cross-sectional area less than that of the diaphragm; wherein the rear outlet duct, the cylindrical portion of the chamber, and the front outlet duct are coaxial, so the rear outlet duct and the front outlet duct are aligned with each other, the front restrictive duct portion and the rear restive duct portion having a same cross-sectional area.

16. A headphone or earphone as claimed in claim 15 wherein the driver is clamped with resilient element that engages with its front face near a periphery, the resilient element being compressed between the driver and the end face of the front cavity.

17. A headphone or earphone as claimed in claim 16 also comprising a resilient element that engages with a rear face of the driver near a periphery, so the driver is clamped between two such resilient elements.

18. A headphone or earphone as claimed in claim 15 wherein at least one resilient element combines a first item that is rigid with a second item that is resilient, so as to provide greater axial length.

19. A headphone or earphone as claimed in claim 15 wherein the front outlet duct has a wider portion at an end closest to the driver that tapers down to the front restrictive duct portion.

20. A headphone or earphone as claimed in claim 19 wherein the front outlet duct also has a widening portion at an end furthest from the driver.

21. A headphone or earphone as claimed in claim 15 wherein the front restrictive duct portion has the cross-sectional area between 20% and 29% of a cross-sectional area of the diaphragm.

* * * * *